US005904777A

United States Patent [19]

Nakatogawa et al.

[11] Patent Number: 5,904,777

[45] Date of Patent: May 18, 1999

[54] MAGNETIC ONE-COMPONENT DEVELOPMENT APPARATUS

[75] Inventors: Kenji Nakatogawa; Shigeo Ohta, both of Ebina, Japan

[73] Assignee: Fuji Xerox Co., Ltd., Tokyo, Japan

[21] Appl. No.: 08/632,068

[22] Filed: Apr. 15, 1996

[30] Foreign Application Priority Data

Apr. 17, 1995 [JP] Japan ..... 7-090546

[51] Int. Cl.[6] ..... G03G 15/09

[52] U.S. Cl. ..... 118/658; 355/251

[58] Field of Search ..... 355/259, 261, 355/251; 118/651, 661, 656–658; 492/18, 56, 59; 430/120, 122

[56] References Cited

U.S. PATENT DOCUMENTS 3,814,054 6/1974 Tajihi .
4,894,305 1/1990 Hagenbach ..... 430/106.6

FOREIGN PATENT DOCUMENTS 63-311367 12/1988 Japan .
4-166864 6/1992 Japan .
4-246676 9/1992 Japan .
6-242672 9/1994 Japan .

*Primary Examiner*—Robert Beatty
*Attorney, Agent, or Firm*—Oliff & Berridge

[57] ABSTRACT

The present invention provides a development apparatus which can operate free from development ghost or bias leak, can form a good image free of defects such as development ghost even if the foregoing negative-working magnetic one-component developer is used and can exhibit an excellent environmental stability of image density even under high temperature and humidity conditions. The magnetic one-component development apparatus according to the present invention comprises a developer carrier provided opposed to an electrostatic latent image retainer. The surface the developer carrier comprises an electrically-conductive resin layer containing as a particulate electrically-conductive material a carbon black and a graphite. The ash content in the graphite is not more than 3.0% by weight. The volume intrinsic resistivity of the electrically-conductive resin layer preferably falls within a range of from $2.0\times10^{-2}$ to 0.99 Ω·cm. As the developer to be supported on the developer carrier there may be used a negatively-chargeable magnetic one-component developer.

14 Claims, 1 Drawing Sheet

MAGNETIC ONE-COMPONENT DEVELOPMENT APPARATUS

FIELD OF THE INVENTION

The present invention relates to a development apparatus for use in an image forming apparatus employing electrophotography such as electrophotographic copying machine, printer and facsimile telegraph. More particularly, the present invention relates to a magnetic one-component (or single-component) development apparatus comprising a developer carrier for carrying a magnetic one-component developer to a development zone for developing an electrostatic latent image and an electrically conductive resin layer formed on said developer carrier.

BACKGROUND OF THE INVENTION

As methods for developing an electrostatic latent image formed on an electrostatic latent image retainer (photoreceptor) in an image forming apparatus employing electrophotography there have heretofore been known various methods depending on the kind of the developer used. Among these methods is a method which comprises allowing a developer supported on a developer carrier to come into contact with a photoreceptor or allowing the developer to fly onto the photoreceptor to effect development. As the surface layer of the developer carrier for carrying the developer there have been proposed various resin layers.

For example, JP-A-63-311367 (The term "JP-A" as used herein means an "unexamined published Japanese patent application") discloses a developer carrier which comprises as a surface layer an external layer having a predetermined relationship between the volume intrinsic resistivity ($1\times10^{6}$ to $1\times10^{13}$ Ω·cm) and the thickness to enhance gradation and fine line/halftone dot gradation reproducibility. JP-A-4-166864 discloses a developer carrier which comprises as a surface layer a thin layer containing a positively-chargeable particulate resin and employs as a developer a negatively-chargeable (one-component) magnetic toner to inhibit the drop of the initial image density due to broad distribution of charge in the developer at the starting of the development apparatus. Further, JP-A-4-246676 discloses a developer carrier which has been polished so that the average roughness pitch Sm on the surface film layer and the central line average roughness Ra are restricted to inhibit a phenomenon that the same pattern images obtained by repeated printing show a reduced density partly along the feed direction of the paper.

However, it can hardly be said that the conventional developer carriers can be put into practical use. These conventional developer carriers have the following disadvantages.

In particular, the developer carrier disclosed in JPA-63-311367 is disadvantageous in that the external layer has a high resistivity. Thus, electric charge remains on the area of the external layer from which the developer has migrated to the photoreceptor during development. This area has more electric charge than other areas. The developer which is subsequently supported on this area is adsorbed by the external layer too strongly to migrate to the photoreceptor. This results in a so-called development ghost that deteriorates the image quality. In some detail, the newly developed toner image shows a reduced density at the area corresponding to early developed toner images.

The developer carrier disclosed in JP-A-4-166864 is disadvantageous in that the dispersion of the positively-chargeable particulate resin is locally ununiform, making the resistivity of the thin layer ununiform. Thus, the thin layer having a reduced resistivity allows easy passage of electric current, causing the generation of bias leak across this area and the photoreceptor. This can destroy the surface of the photoreceptor. If the photoreceptor has defects such as pinhole on the surface thereof, the resulting image has coarse grains and hence a reduced quality. Further, if a negatively-chargeable magnetic toner comprising as a developer a silica capable of being strongly negatively charged is used, development ghost, which shows the history of print pattern, can occur on the development carrier.

The development carrier disclosed in JP-A-4-246676 is disadvantageous in that the average roughness pitch Sm on the surface film layer is too small. Thus, the developer grains are caught by the grooves on the film layer and thus can hardly migrate to the photoreceptor. Accordingly, the developer grains on the developer grains caught by the grooves are insufficiently charged, causing an image density drop.

As mentioned above, the conventional developer carriers coated with a resin layer as a surface layer are disadvantageous in that they are apt to development ghost or bias leak due to the excess or shortage of charge in the developer provided by frictional charging, the use of a negative-working developer comprising an external additive capable of being strongly negatively charged or the generation of discharge between the resin layer and the surface of the photoreceptor attributed to the ununiformity of the resistivity of the resin layer.

SUMMARY OF THE INVENTION

It is therefore an object of the present invention to provide a magnetic one-component development apparatus which can operate free from development ghost or bias leak and can form a good image free of defects such as development ghost even if the foregoing negative-working magnetic one-component developer is used.

It is another object of the present invention to provide a magnetic one-component development apparatus which is environmentally stable enough to form a good image even under high temperature and humidity conditions or low temperature and humidity conditions and durable enough to prevent filming due to the adherence of the developer even after repeated use.

These and other objects of the present invention will become more apparent from the following detailed description and examples.

The inventors have made extensive studies of the enhancement of image quality in an image forming apparatus, as a magnetic one-component development apparatus, equipped with a developer carrier comprising an electrically conductive resin layer as a surface layer. As a result, it was found that some images outputted from this magnetic one-component development apparatus have image defects closely related to the particulate electrically-conductive substance in the resin layer. These defects were finally found to be attributed to the ash content in the graphite. It was therefore found that the foregoing objects of the present invention can be accomplished by minimizing the ash content. The present invention has thus been worked out.

The magnetic one-component development apparatus according to the present invention employs a negatively-chargeable magnetic one-component developer and comprises a developer carrier provided opposed to an electrostatic latent image retainer, characterized in that the surface of the developer carrier comprises an electrically-conductive resin layer containing as a particulate electrically-conductive material a carbon black and a graphite, said graphite having an ash content of not more than 3.0% by weight.

The magnetic one-component developer carrier for use in the present invention comprises an electrically-conductive resin layer as a surface layer containing as main component electrically-conductive particulate carbon black and graphite, in which a good image without generating ghost can be obtained regardless of environment by controlling the ash content of the graphite to 3 wt% or less. That is, the present inventors noted that the ash content of the graphite effects an influence to the chargeability of the developer by contacting the developer with the graphite which has come out to the surface of the developer carrier. Accordingly, the present inventors found that a developer carrier can be obtained efficiently by properly controlling the ash content according to a process condition.

BRIEF DESCRIPTION OF THE DRAWINGS

By way of example and to make the description more clear, reference is made to the accompanying drawings in which.

DETAILED DESCRIPTION OF THE INVENTION

Figure 1:
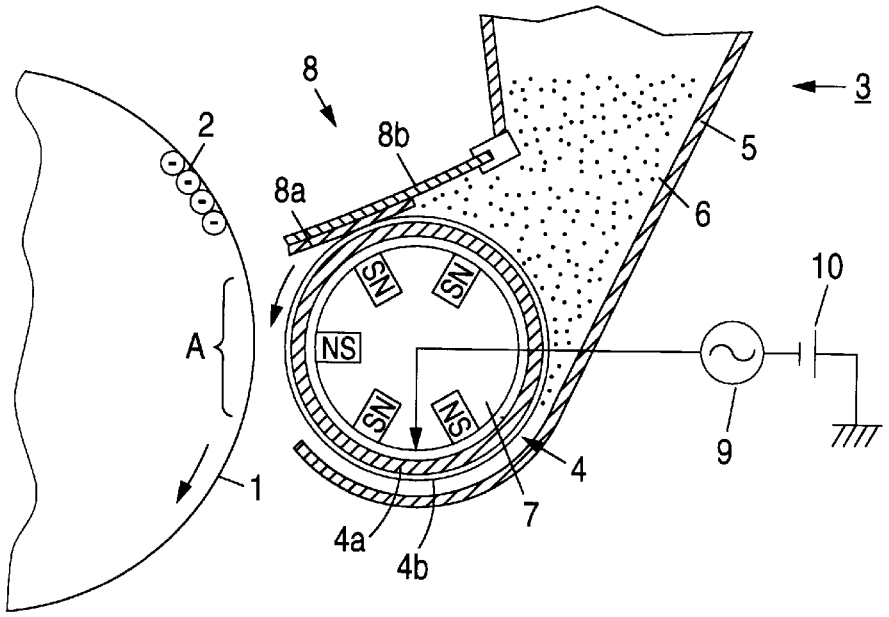
FIG. 1 illustrates an embodiment of the magnetic one-component development apparatus according to the present invention.

The present invention will be further described hereinafter. For the purpose of facilitating the understanding of the present invention, the elements as described hereinafter will be designated by the same reference numeral as used for the corresponding elements in the examples described later. However, the present invention is not limited to the examples.

The electrically-conductive resin layer (4*b*) in the magnetic one-component development apparatus (3) according to the present invention will be described hereinafter.

In order to form the foregoing resin layer (4*b*), a binder resin, a carbon black, a graphite, a diluent (solvent), etc. are mixed to prepare a coating solution. During this procedure, the mixing ratio of the diluent is properly controlled to provide the coating solution with desired viscosity and film-making properties. Subsequently, the coating solution is applied to a cylindrical substrate (4*a*) by means of an air or the like while the substrate is being rotated. The binder resin is then cured at a temperature of 130° C. to 250° C. As the substrate (4*a*) there may be used an electrically-conductive member made of aluminum, stainless steel or the like.

The resin layer (4*b*) thus formed comprises a particulate carbon black and a particulate graphite dispersed therein. The surface of the resin layer (4*b*) has these particulate materials partly exposed to assume a fine roughness. The particulate electrically-conductive graphite to be dispersed in the resin layer (4*b*) has an ash content of not more than 3.0% by weight. With this particulate electrically-conductive graphite, a magnetic one-component developer (6) can be stably adsorbed to and carried by the resin layer (4*b*), and charged.

Examples of the binder resin employable herein include phenol resin, melamine resin, urea resin, alkyd resin, epoxy resin, polyamide resin, polyimide resin, polyester resin, polyurethane resin, polycarbonate resin, styrene resin, fluororesin, acrylic resin, and silicone resin. Preferred among these binder resins are those having an excellent mechanical strength such as phenol resin, polyamide resin, polyester resin, polyurethane resin and styrene resin and those having excellent release properties such as fluororesin and silicone resin.

Examples of the diluent employable herein include hydrocarbons such as hexane, benzene, toluene and xylene, ketones such as acetone, methyl ethyl ketone and cyclohexanone, alcohols such as methanol, ethanol and butanol, ethers such as dibutyl ether, tetrahydrofuran and propylene glycol monomethyl ether, and esters such as ethyl acetate, butyl acetate and ethyl acetate.

These binder resins and diluents may be used singly or in combination.

The foregoing carbon black is dispersed in the electrically-conductive resin layer (4*b*) to prevent the toner (magnetic one-component developer (6)) from being excessively charged. The carbon black acts to allow the escape of excess charge. The graphite has the same action as the carbon black. Because of its surface slipperiness, the graphite also acts to prevent the surface of the resin layer (4*b*) from attracting the toner. The graphite further provides the resin layer (4*b*) with a proper surface roughness that allows the toner to be fully charged by friction.

The graphite normally comprises impurities such as silicon and various metals incorporated therein. Though not confirmed, a certain kind of metal acts electromagnetically on the developer carrier (4). In the present invention, the ash content in the graphite can be controlled to not more than 3.0% by weight to minimize the electromagnetic effect on the carrier (4). Accordingly, the chargeability of the magnetic one-component developer (6) can be invariably stabilized. Further, better results can be provided by satisfying the following conditions.

The resin layer (4*b*) preferably contains the foregoing carbon black and graphite in an amount of from 3 to 30% by weight and from 10 to 70% by weight, more preferably from 5 to 25% by weight and from 20 to 60% by weight, respectively. The mixing ratio of carbon black to graphite by weight is preferably from 1:0.5 to 1:15, more preferably from 1:1 to 1:5. The sum of the amount of carbon black and graphite to be incorporated in the resin layer (4*b*) is preferably from 15 to 80% by weight, more preferably from 20 to 70% by weight. The ash content of the graphite is preferably not more than 3.0 wt%, more preferably not more than 0.5 wt%, furthermore preferably not more than 0.2 wt%. The ash content in the graphite may be reduced by treating with acid (e.g., hydrochloric acid) and treating with alkali (e.g., caustic soda). The acid treatment can remove an iron content in the graphite. The alkali treatment can remove silica and alumina contents in the graphite. Additionally, the ash content in the graphite may be further reduced by treating with hydrofluoric acid and/or with halogen gas.

If the amount of carbon black and graphite to be incorporated in the resin layer (4*b*) fall below 3% by weight and 10% by weight, respectively, it can be made impossible to allow the escape of excess charge from the toner, and development ghost tends to generate in the image formed. On the contrary, if the amount of carbon black and graphite to be incorporated in the resin layer (4*b*) exceed 30% by weight and 70% by weight, respectively, the chargeability of the toner can run short, resulting in the image density drop.

Further, if the amount of graphite to be incorporated in the resin layer (4*b*) falls below 10% by weight, the resin layer (4*b*) tends to have too great a smoothness and an insufficient slipperiness attributed to the average grain diameter described later. Accordingly, the amount of the toner which can be carried by the carrier runs short, causing the image density drop. At the same time, the developer carrier is rendered more attractive to the toner. On the contrary, if the amount of graphite to be incorporated in the resin layer (4*b*) exceeds 70% by weight, the resin layer (4*b*) exhibits too great a surface roughness and thus carries too much toner to provide a sufficient chargeability by friction.

Moreover, if the mixing ratio of graphite to carbon black falls below 0.5, the escape of charge from the toner tends to be excessive, causing a chargeability drop. On the contrary, if the mixing ratio of graphite to carbon black exceeds 15, it can lead to excessive conveyance of the toner or chargeability drop, as in the case where the amount of graphite to be incorporated exceeds 70% by weight. If the sum of the amount of particulate electrically-conductive materials to be incorporated in the resin layer (4*b*) falls below 15% by weight, it not only makes it impossible to provide a sufficient electrical conductivity but also provides the resin layer (4*b*) with too smooth a layer that cannot carry the toner sufficiently. On the contrary, if the sum of the amount of particulate electrically conductive materials to be incorporated in the resin layer (4*b*) exceeds 80% by weight, it can be made difficult to mix the particulate electrically-conductive materials homogeneously with the binder resin, making it difficult to form the resin layer (4*b*).

The average grain diameter of the particulate carbon black and graphite are preferably from 0.01 to 0.2 $\mu$m and from 1 to 10 $\mu$m, respectively.

If the average grain diameter of the particulate carbon black falls below 0.01 $\mu$m, the atomization of carbon black requires much cost. Further, if the grain diameter of the particulate carbon black is reduced, the electrical conductivity of the electrically-conductive resin layer is not so raised. On the contrary, if the average grain diameter of the particulate carbon black exceeds 0.2 $\mu$m, the resulting electrical conductivity of the particulate electrically-conductive material is too low to avoid excessive charging of the toner during friction. If the average grain diameter of the particulate graphite falls below 1 $\mu$m, the amount of the toner which can be carried by the carrier runs short, causing an image density drop. On the contrary, if the average grain diameter of the particulate graphite exceeds 10 $\mu$m, the developer carrier (4) carries too much a toner to come into contact with the toner sufficiently, making it impossible to provide the toner with a sufficient chargeability by friction. This also reduces the resulting image density.

The thickness of the electrically-conductive resin layer (4*b*) is preferably from 10 to 40 $\mu$m, more preferably from 15 to 30 $\mu$m. If the thickness of the electrically-conductive resin layer (4*b*) falls below 10 $\mu$m, it is more likely that the foregoing particulate electrically-conductive materials come out to the surface of the resin layer (4*b*), making the surface of the carrier (4*b*) rougher than required. On the contrary, if the thickness of the electrically-conductive resin layer (4*b*) exceeds 40 $\mu$m, the coating solution of the electrically-conductive resin layer can drip from the cylindrical substrate (4*a*) during curing, making it difficult to form the resin layer to a uniform thickness.

Further, in the present invention, the ash content in the fine roughness portion made of the particulate carbon black and graphite which come out to the surface of the resin layer (4*b*) is defined. Thus, the ash content is closely related to the surface roughness and important. The inventors derived the following relationship. The following is the result of the case where the ash content in the graphite contained in the developer carrier is 3 wt% or less. The arithmetically-averaged surface roughness Ra of the electrically-conductive resin layer (4*b*) is preferably from 0.8 to 2.5 $\mu$m, more preferably from 1.0 to 2.2 $\mu$m. The average roughness pitch Sm is preferably from 95 to 150 $\mu$m, more preferably from 100 to 140 $\mu$m.

If the arithmetically-averaged roughness of the electrically-conductive resin layer (4*b*) falls below 0.8 $\mu$m, the resin layer (4*b*) tends to have too smooth a surface to carry a sufficient amount of the toner, causing an image density drop. On the contrary, if Ra exceeds 2.5 $\mu$m, the resin layer (4*b*) tends to carry too much a toner to provide the toner with a sufficient chargeability, resulting in the drop of the image density. Further, if the average pitch Sm deviates from the above defined range, the resulting image tends to show development ghost that deteriorates the quality thereof.

In particular, if the arithmetically-averaged roughness Ra falls within the range of from 1.0 to 2.2 $\mu$m, an even better image can be formed. Further, if the average pitch Sm falls within the range of from 100 to 140 $\mu$m, the resulting image has no development ghost and thus has an even better quality.

The foregoing arithmetically-averaged roughness Ra and average roughness pitch Sm together represent a surface roughness defined in JIS B 0601.

The volume intrinsic resistivity of the electrically-conductive resin layer (4*b*) is preferably from $2.0\times10^{-2}$ to 0.99 $\Omega\cdot$cm, more preferably from $3.0\times10^{-2}$ to 0.80 $\Omega\cdot$cm.

If the volume intrinsic resistivity of the resin layer (4*b*) falls below $2.0\times10^{-2}$ $\Omega\cdot$cm, the toner tends to be charged too low to provide a sufficient image density. On the contrary, if the volume intrinsic resistivity of the resin layer (4*b*) exceeds 0.99 $\Omega\cdot$cm, the toner tends to be charged to an extent such that development ghost can easily occur.

The magnetic one-component developer (6) to be used in the development apparatus (3) of the present invention will be further described hereinafter.

The foregoing developer comprises at least a binder resin and a magnetic material as essential components. A charge controller, a fluidity accelerator, a cleaning aid, etc. may be added to the developer externally or internally.

Examples of the binder resin employable herein include homopolymers such as styrenes (e.g., styrene, vinyltoluene, chlorostyrene), monoolefins (e.g., vinylnaphthalene, ethylene, propylene, n-butylene, i-butylene), dienes (e.g., butadiene, isoprene), halogenated vinyls (e.g., vinyl fluoride, vinyl chloride, vinyl bromide, vinylidene chloride), vinyl esters (e.g., vinyl acetate, vinyl propionate, vinyl butyrate, vinyl stearate, vinyl benzoate), various derivatives of $\alpha$-methylenealiphatic monocarboxylic acid (e.g., acrylic acid, methyl acrylate, ethyl acrylate, butyl acrylate, octyl acrylate, dodecyl acrylate, $\beta$-chloroethyl acrylate, methacrylic acid, methyl methacrylate, ethyl methacrylate, butyl methacrylate, dodecyl methacrylate, amide acrylate, acrylonitrile, methacrylonitrile), unsaturated polyvalent carboxylic acid esters (e.g., monomethyl maleate, dimethyl maleate, diethyl maleate, dibutyl maleate), vinyl ethers (e.g., vinyl methyl ether, vinyl ethyl ether, vinyl butyl ether) and vinyl ketones (e.g., vinyl methyl ketone, vinyl hexyl ketone, vinyl propenyl ketone), and copolymers thereof. Further examples of the binder resin employable herein include polyurethane, polyester, polyamide, phenolic resin, epoxy resin, furan resin, silicone resin, paraffin wax, and modified rosin.

Examples of the magnetic material employable herein include metals such as iron, cobalt and nickel, alloys of these metals, alloys of these metals with other various metals (e.g., Mg, Al, Ti, V, Mn, Cu, Zn, Sn, W, Pb), ferrite, manganese-zinc-containing ferrite, nickel-zinc-containing ferrite, magnetite, hematite, and cobalt-added iron oxide. The average grain diameter of such a particulate magnetic material is preferably from 0.05 to 1 $\mu$m.

The content of the magnetic material in the magnetic one-component developer is preferably from 20 to 70% by weight, more preferably from 30 to 60% by weight. If the content of the magnetic material falls below 20% by weight, the chargeability can hardly be controlled, deteriorating the resolution, fine line reproducibility and gradation. On the contrary, if the content of the magnetic material exceeds 70% by weight, the transfer efficiency is reduced under high temperature and humidity conditions. Further, it is made difficult to disperse the particulate magnetic material uniformly in the binder resin.

In order to render the developer negatively chargeable upon friction, it is preferred that the developer comprise a negative charge controller incorporated therein. The negative charge controller is not specifically limited so far as it is a known electron attractive substance. Examples of the electron attractive substance employable herein include complexes of salicylic acid derivatives such as salicylic acid and alkylsalicylic acid with transition metals such as chromium, azo metal-containing dyes, phenols, organic acids such as carboxylic acid and sulfonic acid, and chlorinated paraffin. Other examples of the electron attractive substance employable herein include electron attractive substances obtained by introducing carboxylic acid or sulfonic acid into the foregoing binder resins or other polymers at its side chains. Further, the friction-chargeability of a binder resin or external additive having an electron attractive substituent can be utilized itself.

In order to improve the offset resistance of the developer, the developer may comprise a release agent such as low molecular weight polyethylene, low molecular weight polypropylene, microcrystalline wax and paraffin wax incorporated therein. Further, for the purpose of enhancing the durability, fluidity and cleanability of the developer, a finely divided powder of an inorganic material such as silica, organic material such as aliphatic acid metallic salt or derivative thereof or resin such as styrene resin, fluororesin and acrylic resin may be added externally to the developer. Further, a caking inhibitor may be added externally to the developer.

The average grain diameter of such a magnetic one-component developer is preferably from 5 to 20 $\mu$m.

In operation, the magnetic one-component development apparatus (3) according to the present invention works as follows. The magnetic one-component developer (6) supported by the developer carrier (4) is negatively charged upon friction. Since the electrically-conductive resin layer (4*b*) forming the surface layer of the carrier (4) comprises a carbon black and a graphite as particulate electrically-conductive materials, the amount of the developer (6) to be carried by the carrier (4) and the amount of charge to be provided to the developer (6) can be controlled to proper values. When the volume intrinsic resistivity of the resin layer (4*b*) is predetermined to a range of from $2.0\times10^{-2}$ to 0.99 Ω·cm, the foregoing amounts can be controlled to even better values.

In the present invention, the ash content of the graphite is defined to not more than 3.0% by weight to reduce the content of impurities (e.g., metal) in the graphite as compared with the conventional developer carrier. As a result, the developer carrier (4) itself, and hence the development zone between the carrier (4) and the electrostatic latent image retainer (1) are little subject to electromagnetic effect of impurities. Further, the carrier (4) has less environmental dependence due to impurities. Thus, it is presumed that the magnetic one-component developer (6) can be provided with an invariably stable chargeability.

Accordingly, the developer (6) can be properly and uniformly charged. At the same time, development ghost and bias leak can be effectively prevented. Further, the environmental stability of image density is excellent, making it possible to keep the image density high even under high temperature and humidity conditions.

EXAMPLES

The present invention will be further described in the following examples, but the present invention should not be construed as being limited thereto.

Figure 2:
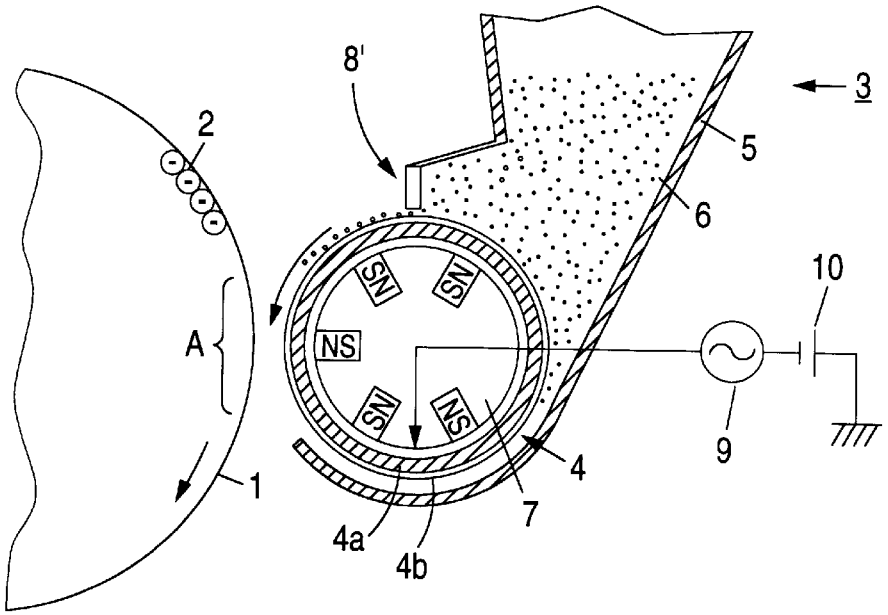
FIG. 2 illustrates another embodiment of the magnetic one-component development apparatus according to the present invention, wherein the reference numeral 1 indicates an electrostatic latent image retainer, the reference numeral 3 indicates a magnetic one-component development apparatus, the reference numeral 4 indicates a developer carrier, the reference numeral 4*b* indicates an electrically-conductive resin layer, and the reference numeral 6 indicates a magnetic one-component developer.

FIGS. 1 and 2 each illustrate a development apparatus loaded with a magnetic one-component developer. In FIG. 1, the electrostatic latent image retainer 1 is a photoconductive drum having an organic photosensitive layer. The electrostatic latent image retainer 1 is uniformly charged by a charging means (not shown), and then imagewise irradiated with light to produce a potential difference by which an electrostatic latent image 2 is then formed. When the electrostatic latent image 2 is formed, the resulting surface potential is −600 V on the image area and −120 V on the background area, which correspond to the white area of the final image.

The magnetic one-component development apparatus 3 comprises a developer carrier 4 provided opposed to the electrostatic latent image retainer 1. The hopper 5 of the development apparatus 3 is adapted to hold the magnetic one-component developer 6 to be supported by the carrier 4. The hopper 5 contains the carrier 4 provided thereinside. The hopper 5 is opened in such an arrangement that the carrier 4 is partially exposed on the area opposed to the retainer 1. The hopper 5 is positioned in such an arrangement that the carrier 4 and the retainer 1 are positioned close to each other.

The developer carrier 4 is provided in such an arrangement that when it rotates, it carries the magnetic one-component developer 6 attached thereto to the development zone A at a minimum gap of about 200 $\mu$m from the electrostatic latent image retainer 1. Inside the carrier 4 is provided a magnet roll 7 which comprises a plurality of magnets arranged circumferentially and is fixed so that it is not rotated. The plurality of magnets form a magnetic pattern having S and N poles circumferentially arranged. The developer 6 can be adsorbed by the surface of the carrier 4 according to this magnetic pattern.

The developer carrier 4 comprises a cylindrical aluminum substrate 4*a* having a thickness of 0.7 mm and an electrically-conductive resin layer 4*b* formed on the circumference of the cylindrical aluminum substrate 4*a*. The resin layer 4*b* comprises a particulate electrically-conductive carbon black and a particulate electrically-conductive graphite dispersed therein. The resin layer 4*b* comprises a film layer formed by applying to the substrate 4*a* the coating solution described later having a particulate electrically-conductive carbon black and a particulate electrically-conductive graphite dispersed in a binder resin and a diluent. The developer regulating member 8' in FIG. 2 is fixed in such an arrangement that it doesn't come into contact with the developer carrier. The developer can be carried by the developer carrier through the gap between the developer regulating member 8' and the developer carrier in a predetermined amount toward the photoreceptor. The experimental results show that the following process shown in FIG. 1 can provide better results. The developer regulating member 8 comprises an elastic member 8*a* provided in contact with the surface of the developer carrier 4 and a leaf spring 8*b* to which the elastic member 8*a* is bonded. The leaf spring 8*b* is fixed to the main body of the development apparatus 3 at one end thereof. The area of the elastic member 8*a* which comes into contact with the carrier 4 is positioned above the foregoing development zone A with respect to the rotational direction of the carrier 4. The leaf spring 8*b* descends toward its free end in such an arrangement that the free end is below the other end with respect to the rotational direction of the carrier 4.

The elastic member 8*a* comprises a silicone rubber having a width of 15 mm, a thickness of 1.00 mm and a rubber hardness of 50°. The leaf spring 8*b* comprises a 0.1-mm thick stainless steel plate (SUS304CSP3/4; tensile strength: 95 kgf/mm$^2$). In other words, the use of the developer regulating member 8 allows the developer to come into contact with the surface roughness of the developer carrier more efficiently.

An a.c. voltage having a d.c. voltage superposed thereon from a series combination of a high a.c. voltage power supply 9 and a d.c. voltage power supply 10 is applied as a bias voltage to the substrate 4*a* of the developer carrier 4 so that an a.c. voltage is generated across an electrode connected to the electrically-conductive layer of the electrostatic latent image retainer 1 and the substrate 4*a* in the development zone A.

The operation of the magnetic one-component development apparatus according to the present invention will be described hereinafter.

Prior to the operation of the magnetic one-component development apparatus 3, the development apparatus 3 loaded with the negatively-chargeable magnetic one-component developer 6 is mounted on the laser printer.

In the development of the electrostatic latent image formed on the electrostatic latent image retainer 1, the developer 6 in the hopper 5 is attached to the surface of the rotating developer carrier 4 so that it is rubbed by the elastic member 8*a* of the developer regulating member 8 and the electrically-conductive resin layer 4*b* having a fine surface roughness. The particulate carbon black and graphite dispersed in the resin layer 4*b* partly come out to the surface of the resin layer 4*b* to control the surface roughness of the carrier 4 to a proper value. In this arrangement, the developer 6 can be supported on the carrier 4 to a thickness great enough to develop the electrostatic latent image 2. Further, since the graphites set forth in the following examples are each dispersed in the resin layer 4*b*, the developer 6 can be uniformly and sufficiently charged negatively upon friction.

The developer 6 which has thus been supported on the carrier 4 to a reduced thickness is then carried to the development zone A as the carrier 4 rotates. The negatively charged developer grains then fly back and forth in the a.c. field produced at the gap between the carrier 4 and the retainer 1. The reciprocation of the developer 6 causes the grains to collide with each other to make the entire developer 6 cloudy. The cloud of the developer 6 is attracted by the electrostatic latent image 2 on the retainer 1 under the influence of the d.c. component of the bias voltage. In this arrangement, the developer is compressed by the developer regulating member. Accordingly, better results can be obtained with the developer carrier of the present invention.

EXAMPLE 1

A process for the formation of an electrically-conductive resin layer (4*b*) will be described below.

| | |
|---|---|
| Binder resin<br>Phenol resin (molecular weight: 1,000–3,000) | 100 parts<br>by weight |
| Particulate electrically-conductive material<br>Carbon black (XC-72R, available from Cabot Co., Ltd.) | 20 parts<br>by weight |
| Graphite (available from Nihon Kokuen K.K.; ash content: 3.0 wt %; treated with acid and alkali) | 50 parts<br>by weight |
| Diluent<br>2:1 Mixture of propylene glycol monomethyl ether and ethanol | 100 parts<br>by weight |

The foregoing composition was subjected to processing by a bead mill so that the particulate electrically-conductive materials were dispersed in the binder resin with the diluent. The coating solution thus obtained was spray-coated onto an aluminum substrate (4*a*). The coated material was then heated and cured at a temperature of 160° C. in a drying furnace for 30 minutes to form an electrically-conductive resin layer (4*b*).

The resin layer (4*b*) thus formed had an arithmetically-averaged surface roughness Ra of 1.50 $\mu$m, an average roughness pitch Sm of 100 $\mu$m and a thickness of 20 $\mu$m. The volume intrinsic resistivity of the resin layer (4*b*) was $8.0\times10^{-2}$ Ω·cm.

The foregoing magnet roll (7) was then fixed inside the foregoing substrate (4*a*). The developer carrier (4) thus prepared was then mounted on the magnetic one-component development apparatus (3) shown in FIG. 1 to prepare the development apparatus (3) according to the present invention.

The procedure of Example 1 was followed in Examples 2 to 11 and Comparative Examples 1 and 2 to prepare magnetic one-component development apparatus (3). In the following examples and comparative examples, the ash content in the graphite, the process for the formation of the electrically-conductive resin layer (4*b*) and the foregoing physical properties will be given.

EXAMPLE 2

The procedure of Example 1 was followed to prepare an electrically-conductive resin layer except that a graphite having an ash content of 2.0 wt% was used. The resin layer thus formed had an arithmetically-averaged surface roughness Ra of 1.40 $\mu$m, an average roughness pitch Sm of 110 $\mu$m and a thickness of 22 $\mu$m. The volume intrinsic resistivity of the resin layer was $8.0\times10^{-2}$ Ω·cm.

EXAMPLE 3

The procedure of Example 1 was followed to prepare an electrically-conductive resin layer except that a graphite having an ash content of 1.0 wt% was used. The resin layer thus formed had an arithmetically-averaged surface roughness Ra of 1.35 μm, an average roughness pitch Sm of 120 μm and a thickness of 24 μm. The volume intrinsic resistivity of the resin layer was 0.12 Ω·cm.

EXAMPLE 4

The procedure of Example 1 was followed to prepare an electrically-conductive resin layer except that a graphite having an ash content of 1.0 wt% was used and the rotary speed of the spray coater, the jetted amount of the coating solution and the distance between the spray gun and the substrate were changed. The resin layer thus formed had an arithmetically-averaged surface roughness Ra of 1.20 μm, an average roughness pitch Sm of 115 μm and a thickness of 24 μm. The volume intrinsic resistivity of the resin layer was 0.11 Ω·cm.

EXAMPLE 5

The procedure of Example 1 was followed to prepare an electrically-conductive resin layer except that a graphite having an ash content of 1.0 wt% was used and the rotary speed of the spray coater, the jetted amount of the coating solution and the distance between the spray gun and the substrate were changed from that used in Examples 1 and 4. The resin layer thus formed had an arithmetically-averaged surface roughness Ra of 0.80 μm, an average roughness pitch Sm of 105 μm and a thickness of 23 μm. The volume intrinsic resistivity of the resin layer was $9.0\times10^{-2}$ Ω·cm.

EXAMPLE 6

The procedure of Example 1 was followed to prepare an electrically-conductive resin layer except that a graphite having an ash content of 0.5 wt% was used. The resin layer thus formed had an arithmetically-averaged surface roughness Ra of 1.30 μm, an average roughness pitch Sm of 105 μm and a thickness of 21 μm. The volume intrinsic resistivity of the resin layer was 0.10 Ω·cm.

EXAMPLE 7

The procedure of Example 1 was followed to prepare an electrically-conductive resin layer except that a graphite having an ash content of 0.5 wt% was used and the rotary speed of the spray coater, the jetted amount of the coating solution and the distance between the spray gun and the substrate were changed. The resin layer thus formed had an arithmetically-averaged surface roughness Ra of 1.70 μm, an average roughness pitch Sm of 135 μm and a thickness of 22 μm. The volume intrinsic resistivity of the resin layer was $9.0\times10^{-2}$ Ω·cm.

EXAMPLE 8

The procedure of Example 1 was followed to prepare an electrically-conductive resin layer except that a graphite having an ash content of 0.5 wt% was used and the rotary speed of the spray coater, the jetted amount of the coating solution and the distance between the spray gun and the substrate were changed from that used in Examples 1 and 7. The resin layer thus formed had an arithmetically-averaged surface roughness Ra of 0.80 μm, an average roughness pitch Sm of 103 μm and a thickness of 20 μm. The volume intrinsic resistivity of the resin layer was 0.11 Ω·cm.

EXAMPLE 9

The procedure of Example 1 was followed to prepare an electrically-conductive resin layer except that a graphite having an ash content of 0.2 wt% was used. The resin layer thus formed had an arithmetically-averaged surface roughness Ra of 1.60 μm, an average roughness pitch Sm of 125 μm and a thickness of 21 μm. The volume intrinsic resistivity of the resin layer was 0.14 Ω·cm.

EXAMPLE 10

The procedure of Example 1 was followed to prepare an electrically-conductive resin layer except that a graphite having an ash content of 0.2 wt% was used and the rotary speed of the spray coater, the jetted amount of the coating solution and the distance between the spray gun and the substrate were changed. The resin layer thus formed had an arithmetically-averaged surface roughness Ra of 1.15 μm, an average roughness pitch Sm of 123 μm and a thickness of 19 μm. The volume intrinsic resistivity of the resin layer was 0.10 Ω·cm.

EXAMPLE 11

The procedure of Example 1 was followed to prepare an electrically-conductive resin layer except that a graphite having an ash content of 0.2 wt% was used and the rotary speed of the spray coater, the jetted amount of the coating solution and the distance between the spray gun and the substrate were changed from that used in Examples 1 and 10. The resin layer thus formed had an arithmetically-averaged surface roughness Ra of 0.78 μm, an average roughness pitch Sm of 100 μm and a thickness of 20 μm. The volume intrinsic resistivity of the resin layer was 0.15 Ω·cm.

COMPARATIVE EXAMPLE 1

The procedure of Example 1 was followed to prepare an electrically-conductive resin layer except that a graphite having an ash content of 4.0 wt% was used. The resin layer thus formed had an arithmetically-averaged surface roughness Ra of 1.40 μm, an average roughness pitch Sm of 125 μm and a thickness of 18 μm. The volume intrinsic resistivity of the resin layer was $1.9\times10^{-2}$ Ω·cm.

COMPARATIVE EXAMPLE 2

The procedure of Example 1 was followed to prepare an electrically-conductive resin layer except that a graphite having an ash content of 4.0 wt% was used and the rotary speed of the spray coater, the jetted amount of the coating solution and the distance between the spray gun and the substrate were changed from that used in Example 1 and Comparative Example 1. The resin layer thus formed had an arithmetically-averaged surface roughness Ra of 0.80 μm, an average roughness pitch Sm of 100 μm and a thickness of 21 μm. The volume intrinsic resistivity of the resin layer was $1.8\times10^{-2}$ Ω·cm.

Printing test

The magnetic one-component development apparatus (3) prepared in Examples 1 to 11 and Comparative Examples 1 and 2 were each mounted on a laser printer (FX4109, available from Fuji Xerox Co., Ltd.). The development apparatus (3) were each then loaded with the following magnetic one-component developer (6). In this arrangement, printing test was conducted under three conditions, i.e., ordinary temperature and humidity conditions (25° C., 40%RH), low temperature and humidity conditions (10° C., 10%RH) and high temperature and humidity conditions (30° C., 90%RH).

The developer (6) used had an average grain diameter of from 7 to 9 μm and the following composition:

| | |
|---|---|
| Binder resin | 100 parts |
| 80:20 Mixture of styrene and n-butyl acrylate copolymer | by weight |
| Magnetic powder | 100 parts |
| Magnetite | by weight |
| Charge controller | 1 part |
| TRH | by weight |
| Wax | 3 parts |
| Low molecular weight polypropylene | by weight |
| External additive | 1 part |
| Hydrophobic silica | by weight |

The printed samples were measured for image density by means of a densitometer (Model 404A, available from X-Rite Inc.). Development ghost and bias leak were visually evaluated in accordance with the following criteria. The results are set forth in Table 1.

Criteria of judgement of image density, development ghost and bias leak p E: Density of not less than 1.50; no image defects observed G: Density of from not less than 1.40 to less than 1.50; little or no image defects observed F: Density of from not less than 1.30 to less than 1.40; some image defects observed, but no practical problems P: Density of less than 1.30; definite image defects observed

TABLE 1

| | Graphite | Ordinary temperature/ humidity conditions | | | Low temperature/ humidity conditions | | | High temperature/ humidity conditions | | |
|---|---|---|---|---|---|---|---|---|---|---|
| Example No. | Ash (%) | Image density | Development ghost | Bias leak | Image density | Development ghost | Bias leak | Image density | Development ghost | Bias leak |
| Example 1 | 3.0 | G | G | G | G | F | G | F | G | G |
| Example 2 | 2.0 | G | G | G | G | G | G | F | G | G |
| Example 3 | 1.0 | G | G | G | G | G | G | G | G | G |
| Example 4 | 1.0 | G | G | G | G | G | G | G | G | G |
| Example 5 | 1.0 | G | G | G | G | G | G | G | G | G |
| Example 6 | 0.5 | E | G | G | E | G | G | G | G | G |
| Example 7 | 0.5 | E | G | G | E | G | G | G | G | G |
| Example 8 | 0.5 | E | G | G | E | G | G | G | G | G |
| Example 9 | 0.2 | E | G | G | E | G | G | E | G | G |
| Example 10 | 0.2 | E | G | G | E | G | G | E | G | G |
| Example 11 | 0.2 | E | G | G | E | G | G | E | G | G |
| Comparative Example 1 | 4.0 | F | G | G | G | F | G | P | G | F |
| Comparative Example 2 | 4.0 | F | G | G | G | F | G | P | G | F |

As can be seen in Table 1, Example 1, which employs a graphite having an ash content of 3.0 wt%, provided results with no practical problems. In Example 2, which employs a graphite having an ash content of 2.0 wt%, good results were obtained with respect to both development ghost and bias leak. In Examples 3 to 5, which employ a graphite having an ash content of 1.0 wt%, good results were obtained with respect to image density, development ghost and bias leak under the various environmental conditions. In Examples 6 to 8, which employ a graphite having an ash content of 0.5 wt%, a good image density was obtained particularly under ordinary and low-temperature conditions. Further, in Examples 9 to 11, which employ a graphite having an ash content of 0.2 wt%, very good results were obtained also with respect to image density under high temperature and humidity conditions.

On the other hand, Comparative Examples 1 and 2, which employ a graphite having an ash content of 4.0 wt%, showed a remarkably low image density under high temperature and humidity conditions.

As is shown in Table 1, when the ash content of the graphite is 0.5 wt% or less, the image density drop is prevented even in the low temperature and humidity conditions. Furthermore, when the ash content of the graphite is 0.2 wt% or less, the image density drop is prevented even in the high temperature and humidity conditions.

Thus, the less the ash content in the graphite to be incorporated in the electrically-conductive resin layer is, the higher is the image density, and the more can be remarkably improved the image density even under high temperature and humidity conditions. Further, if the ash content in the graphite is as low as defined above, little or no development ghost and bias leak can occur.

Furthermore, when the same procedures as in Example 10 were conducted except that the ash content of the graphite were changed from 0.2 wt% to 0.1 wt% and 0 wt%, respectively, good results were obtained even in the stress condition (i.e., high temperature and humidity conditions).

The present invention has been described with reference to the foregoing examples, but the present invention should not be construed as being limited thereto. Various modifications may be made without departing from the spirit or scope of the following claims.

For example, the resin layer may comprise a powder of an electrically-conductive material such as aluminum, copper, stainless steel, tin oxide and indium oxide incorporated therein besides carbon black and graphite so far as the sum of the amount of particulate materials falls within the above defined upper limit. Instead of the developer regulating member for supporting the magnetic one-component developer on the developer carrier to a reduced thickness, a ferromagnetic blade may be provided at a minute gap from the surface of the developer carrier. The developer carrier of the present invention may also be adapted for a positive-working magnetic one-component developer if the various conditions are properly predetermined.

As mentioned above, the magnetic one-component development apparatus according to the present invention has an arrangement such that the ash content in the graphite incorporated with the carbon black in the electrically-conductive resin layer provided as a surface layer of the developer carrier is defined to not more than 3.0% by weight. In this arrangement, the magnetic one-component developer can be properly and uniformly charged. As a result, development ghost and bias leak can be effectively prevented. Further, the magnetic one-component development apparatus according to the present invention can keep the image density high even under high temperature and humidity conditions. Thus, the magnetic one-component development apparatus according to the present invention exhibits an excellent environmental stability of image density.

Accordingly, the magnetic one-component development apparatus according to the present invention can form a good image with an excellent environmental stability of image density free of image defects such as development ghost and bias leak.

While the invention has been described in detail and with reference to specific embodiments thereof, it will be apparent to one skilled in the art that various changes and modifications can be made therein without departing from the spirit and scope thereof.

What is claimed is:

1. A magnetic one-component developer carrier comprising an electrically-conductive resin layer as a surface layer, wherein said electrically-conductive resin layer comprises as particulate electrically-conductive materials (i) a carbon black and (ii) a graphite having an ash content of not more than 3.0% by weight.

2. The magnetic one-component developer carrier according to claim 1, wherein said graphite has an ash content of not more than 0.5% by weight.

3. The magnetic one-component developer carrier according to claim 1, wherein said graphite has an ash content of not more than 0.2% by weight.

4. The magnetic one-component developer carrier according to claim 1, wherein said electrically-conductive resin layer has a volume intrinsic resistivity of from $2.0\times10^{-2}$ to 0.99 Ω·cm.

5. The magnetic one-component developer carrier according to claim 1, wherein said electrically conductive resin layer has an arithmetically-averaged roughness Ra of from 0.8 to 2.5 μm and an average roughness pitch Sm of from 95 to 150 μm.

6. The magnetic one-component developer carrier according to claim 1, wherein said carbon black is used in an amount of from 3 to 30% by weight based on said electrically-conductive resin layer.

7. The magnetic one-component developer carrier according to claim 1, wherein said graphite is used in an amount of from 10 to 70% by weight based on said electrically-conductive resin layer.

8. A development apparatus comprising a magnetic one-component developer carrier and a developer regulating member, wherein said magnetic one-component developer carrier comprises an electrically-conductive resin layer as a surface layer, said electrically-conductive resin layer comprising as particulate electrically-conductive materials (i) a carbon black and (ii) a graphite having an ash content of not more than 3.0% by weight, and said developer regulating member is adapted to form a negatively-chargeable magnetic one-component developer layer on said developer magnetic one-component developer carrier.

9. The development apparatus according to claim 8, wherein said graphite has an ash content of not more than 0.5% by weight.

10. The development apparatus according to claim 8, wherein said graphite has an ash content of not more than 0.2% by weight.

11. The development apparatus according to claim 8, wherein said electrically-conductive resin layer has a volume intrinsic resistivity of from $2.0\times10^{-2}$ to 0.99 Ω·cm.

12. The development apparatus according to claim 8, wherein said electrically conductive resin layer has an arithmetically-averaged roughness Ra of from 0.8 to 2.5 μm and an average roughness pitch Sm of from 95 to 150 μm.

13. The development apparatus according to claim 8, wherein said carbon black is used in an amount of from 3 to 30% by weight based on said electrically-conductive resin layer.

14. The development apparatus according to claim 8, wherein said graphite is used in an amount of from 10 to 70% by weight based on said electrically-conductive resin layer.

* * * * *